US006401731B2

(12) United States Patent
Robertson

(10) Patent No.: US 6,401,731 B2
(45) **Date of Patent: *Jun. 11, 2002**

(54) METHOD OF DECONTAMINATING PCB TRANSFORMERS

(76) Inventor: William Robertson, 2649 Glenwood Drive, Metcalfe, Ontario (CA), K0A 2P0

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 32 days.

(21) Appl. No.: 09/233,850

(22) Filed: Jan. 19, 1999

(51) Int. Cl.[7] ..... B08B 3/04

(52) U.S. Cl. ..... 134/22.19; 134/19; 134/22.1; 134/22.11; 134/22.14; 134/31; 134/35; 210/634; 210/774; 210/909

(58) Field of Search ..... 134/19, 22.1, 22.11, 134/22.19, 31, 35; 210/634, 909, 774

(56) References Cited

U.S. PATENT DOCUMENTS

| | | | | | |
|---|---|---|---|---|---|
| 4,168,989 | A | | 9/1979 | Edelman et al. | 134/28 |
| 4,425,949 | A | | 1/1984 | Rowe, Jr. | 141/1 |
| 4,483,717 | A | | 11/1984 | Olmsted et al. | 134/12 |
| 4,685,972 | A | * | 8/1987 | Fowler | 134/12 |
| 4,699,667 | A | | 10/1987 | Walsh | 134/12 |
| 4,744,905 | A | | 5/1988 | Atwood | 210/634 |
| 4,790,337 | A | * | 12/1988 | Fowler | 134/109 |
| 4,814,021 | A | * | 3/1989 | Massey et al. | 134/12 |
| 4,826,538 | A | | 5/1989 | Sanders et al. | 134/1 |
| 4,828,703 | A | | 5/1989 | Atwood | 210/634 |
| 4,913,178 | A | * | 4/1990 | Fowler | 134/12 |
| 4,950,837 | A | | 8/1990 | Horneck et al. | 174/14 R |
| 4,983,222 | A | | 1/1991 | Green et al. | 134/22.1 |
| 5,122,194 | A | | 6/1992 | Miller et al. | 134/29 |
| 5,226,970 | A | * | 7/1993 | Barnett et al. | 134/14 |
| 5,512,202 | A | | 4/1996 | Borah | 252/142 |
| 5,728,660 | A | | 3/1998 | Borah | 510/110 |

OTHER PUBLICATIONS

Feasibility Study: Removal of PCB from Transformers Servicing The Great Lakes Forestry Centre, 1219 Queen Street, Sault Saint Marie, Ontario (William Robertson, Jun. 23, 1997).

Li et al. "On Site PCB Analysis in support of a transformer rebuilding project". Proc.–Tech. Semin. Chem. Spills, 15$^{th}$ (1998), 129–145. Publisher: Environment Canada, Ottawa, Ont.*

* cited by examiner

*Primary Examiner*—S. Carrillo
(74) *Attorney, Agent, or Firm*—Clifford W. Browning; Woodard, Emhardt, Naughton Moriarty & McNett

(57) ABSTRACT

The decontamination of PCB-containing transformers to obtain treated transformers containing less than 50 parts per million (ppm) polychlorinated biphenyls (PCB) can be achieved using a method wherein the transformer is initially drained of all PCBs; then the core/coil assembly is removed. The internal surfaces of the transformer are then cleaned using a solvent. Finally, a new core/coil assembly is installed. The method is simple and can be completed within a substantially shorter period of time than methods known in the art.

7 Claims, No Drawings

METHOD OF DECONTAMINATING PCB TRANSFORMERS

FIELD OF THE INVENTION

The present invention relates to a method of decontaminating PCB-containing transformers, more particularly to such a method involving a cleaning process of internal surfaces using a solvent wash process.

BACKGROUND OF THE INVENTION

Polychlorinated biphenyls (PCB) are synthetic chemical compounds consisting of chlorine, carbon and hydrogen. First synthesized in 1881, PCBs are relatively fire resistant, very stable, do not conduct electricity and have a very low volatility at normal temperatures. These and other properties have made them desirable components in a wide range of industrial and consumer products. Some of these same properties make PCB environmentally hazardous, especially their extreme resistance to chemical and biological breakdown by natural processes in the environment.

The use of PCB as the insulating fluid in transformers and other electrical products such as fluorescent light ballasts was discontinued in 1978. Up to this time many transformers contained PCB as the insulating liquid replacing mineral oil in applications where a transformer failure with the resulting fire could prove disastrous. Most PCB-containing transformers are located in office buildings.

PCBs are now listed as a toxic substance under the Canadian Environmental Protection Act (CEPA) and its use in new products, and its release into the environment have been prohibited under the Chlorobiphenyl Regulations of CEPA.

Liability considerations are the chief reason for the early phase out of PCB equipments which are otherwise in serviceable condition and have adequate capacity for the operating loads. The risk of accidental release or fire is very small. However, there are substantial costs associated with the spill cleanup or building cleanup following fires originating from a non-PCB source but involving PCB equipment. The vapourization of PCB by high heat generates dioxins and dibenzofurans, which are identified carcinogens. This risk is one of the reasons that many organizations plan for the early retirement of their PCB transformation equipment.

In addition to the total destruction and replacement of PCB-containing transformers, the decontamination of operational PCB transformers is normally carried out by either a series retrofill or in-situ processor method. Both these methods have major flaws in that they either generate large amounts of contaminated transformer fluid as in the series retrofill method or require long processing times as with the in-situ processor method.

There is some doubt associated with the long term benefits of decontaminating PCB transformers without removing the core/coil assembly. This is supported by Environment Canada (EC) who have recommended that even after a transformer has been drained, retro-filled and the fluid decontaminated (with a time frame of 2 to 3 years), the transformer should be tested for an additional three years if the leaching fluid is left in and an additional ten years if it is replaced with silicone fluid. During this time it will remain on Environment Canada's list of PCB-containing equipments and must be treated and labeled as a PCB transformer. Processes that do not remove the core/coil assembly must contend with the problem of leach back. Leach back occurs because of the large amount of porous material such as insulation and wood used in the manufacture of transformer core/coil assemblies. This material by necessity is extremely dry when installed in the transformer. The estimated amount of transformer fluid absorbed by the wood and insulation is between 3% and 5% of the total amount used to fill the transformer. For a 2000 kVa transformer which would hold approximately 1500 liters, the amount absorbed would be between 45 and 75 liters. To contaminate 1500 liters of transformer oil to over 50 ppm would only take approximately 60 grams of PCB. This illustrates the difficulty in decontaminating a PCB transformer without removing the core and coil. The PCB in the core and coil will leach back into the transformer fluid for years. Even after the leach back has slowed to an acceptable level, the PCB contained in the wood has been shown to remain over the acceptable limit of 50 ppm indefinitely and at the end of the transformer life will have to be removed and stored for eventual destruction as PCB waste.

This situation will require that upon the end of the transformer life it will have to be disassembled and the interior components tested for PCB content. As it has been determined by Environment Canada that there will be components that contain PCB over the 50 ppm, these will have to be removed and sent to a licensed PCB destruction facility.

A prior art search conducted at the Canadian Patent Office revealed the following patents that disclose methods of decontaminating PCB transformers: U.S. Pat. Nos. 4,483,717 (Olmsted et al), 4,699,667 (Walsh of Westinghouse), 4,950,837 (Horneck et al of General Electric) and 4,983,222 (Green et al of Union Carbide). They do not appear very satisfactory.

There remains a need for a method of transformer decontamination that avoids the problems associated with known methods and gives consistent reliable results.

SUMMARY OF THE INVENTION

Broadly stating, the present invention provides a method of decontaminating a PCB transformer to a level below 50 ppm when the transformer is re-filled with a new non-PCB fluid, which comprises: (a) removing a transformer core/coil assembly from the PCB transformer from which PCB has been drained off; (b) cleaning all interior surfaces and remaining components of the transformer by application of a cleaning solvent; and (c) installing a new transformer core/coil assembly.

In a preferred embodiment, the process may also include between steps (b) and (c), (d) flushing interior surfaces of the cooling fins with a replacement non-PCB fluid.

According to the process of this invention, a PCB-filled transformer can be reclaimed as a PCB-free transformer by the removal of those components that cannot be adequately cleaned and the solvent washing of all interior surfaces and components. The remaining product will be permanently less than 50 ppm PCB.

DESCRIPTION OF PREFERRED EMBODIMENTS

The existing PCBs are drained from the transformer and may be put in storage for eventual destruction. The PCB draining step is not an essential step of the present invention, since a transformer from which PCBs have already been drained off may be received for processing. The core/coil assembly is removed and may be placed in storage for eventual destruction. The physical construction of the core and coils prevents us from cleaning this portion of the transformer below the levels required to have the transformer declared non-PCB with no danger of leach back.

To all interior surfaces and remaining components of the transformer, a cleaning solvent is applied. A convenient manner of application is to wash and wipe clean them at least once, preferably 2 to 5 times and especially preferably 3 times, with a solvent. VARSOL brand mineral spirits solvent was used in testing this method, however other solvents may be as effective. A preferred solvent is a non-volatile (e.g., a boiling point of at least about 100° C.) hydrocarbon solvent, especially an aliphatic hydrocarbon (such as naphtha) having a boiling point of from about 150 to about 200° C. VARSOL DX 3139 solvent is an aliphatic hydrocarbon (naphtha) solvent having a boiling point of from 159 to 196° C. marketed by Imperial Oil. Other useful solvents include halogenated hydrocarbon solvents such as perchloroethylene. Water containing a detergent may also possibly be used. The cleaning step may be performed manually or mechanically. The volume of the solvent used in the washing step is not critical. By conducting simple experiments, a person skilled in the art would be able to determine appropriate commercially feasible amounts of the solvent and a most appropriate number of washes. The Environment Canada surface contamination criteria are only applicable for material that is going to be declared waste and will have to be stored or transported to a destruction facility. This invention is based on calculations of the total surface area of the inside of a test transformer showing that there are 85 $m^2$ of surface area that will be contaminated with PCB. As the transformer will remain in service, the contamination levels are only relevant in the context of how much can remain, and be combined with the new non-PCB fluid that will be added after the transformer is rebuilt. The resulting fluid must have a PCB contamination level of less than 50 ppm to have the transformer declared non-PCB. The data showing the results of the cleaning of the transformer cooling fins at a pilot project located at Sault Ste Marie, Ontario, show levels in the range of 200 to 300 $\mu$g of PCB's/100 $cm^2$, adequate to retrofill the transformer without danger of contamination by residual PCBs.

After the transformer cooling fins are drained of all PCB fluid and the bottom portion emptied using a suction pump equipped with a wand, the cooling fin headers may be plugged and the fins may be filled with the solvent. In one preferred embodiment, the solvent is then circulated at least once, preferably 2 to 5 times, more preferably 3 separate times for an appropriate time, say 15 minutes to one hour, preferably about 30 minutes, each time with a pump connected to the top and bottom of the cooling fin or bank of fins. The volume of the solvent used is not critical. It is most convenient to use the same volume of the solvent as the interior volume of the fins each time. For example, in the case of a 2000 kVa transformer, about 50 liters of the solvent may be most appropriate for each bank of the fins. Between each solvent circulation cycle, the fluid is drained and the bottoms of all fins are emptied using a suction pump. After the surface cleaning process, any PCB left in the bottom corners of the fins may be removed by using a suction pump. It was found during preliminary investigations and tests, that it is especially preferable to remove any PCB residue left in the bottom corners by a suction pump. The effectiveness of the cleaning methods was verified by measurements of the VARSOL solvent contamination after flushing the fins, typically the measurements after three rinses showed PCB levels under 300 ppm which indicate remaining PCB would not contaminate the retrofill fluid over the allowable limit.

When the cleaning procedure is complete, the residual solvent is desired to be removed from the fin surfaces. This may be accomplished preferably by flushing the interior surfaces of the fins with a small amount of a proposed retrofill fluid. When the proposed retrofill fluid is thick (i.e., viscous) at room temperature, it is desirable to heat it to a certain temperature (for example about 60° C.) to facilitate a good flushing action. The fluid is then removed from the transformer interior and the bottom of the fins is emptied, for example, by using a suction pump.

When the cleaning is completed, the assembly can be rebuilt by installing a new core/coil assembly by anybody regularly engaged in this work. When the transformer has been cleaned, rebuilt, tested and processed to ensure the new fluid does not contain any impurities, it can be filled with any approved non-PCB dielectric fluid and energized.

The safe handling of PCBs is of the highest importance. From the careful removal of the tank top and the replacement of the interior components to ensuring adequate ventilation of the tank interior and surrounding space cleaning and rebuilding methods must ensure that all safety precautions are observed.

An advantage of this method is that the time required is relatively short (for example several hours to a few days to process one transformer). Another advantage is that no particular sophisticated machine or equipment is needed. A further advantage is that a vaporization of a solvent is not normally required, hence the process is safe to both workers and environment.

Test

The validity of this method of rebuilding a PCB transformer was demonstrated through a pilot project conducted at the Confederation Heights central heating plant, in Ottawa, Ontario, Canada.

The methodology used included:

(1) opening the transformer and doing lab tests to determine the levels of PCB on all interior surfaces;

(2) disassembling the core and coils and taking swab tests of all interior surfaces of the copper windings and the steel core laminations in an attempt to decontaminate the steel or copper for reuse;

(3) cleaning all interior surfaces with a variety of solvents, cleaners and abrasives, followed by lab tests to determine the success of the various PCB removal methods;

(4) blocking the cooling fins and circulating a solvent through them with a pump;

(5) removing the cooling fins and cutting them open to determined if the interior surfaces were below the level that would allow one to refill the transformer and have the insulating fluid remain below the required 50 ppm PCB level.

The testing method was as follows: swab tests were taken using the Environment Canada recommended wipe test sampling methodology for transformer metal surfaces. The tests were performed by a certified test lab.

The result obtained were as follows: swab tests taken from various locations in the tank interior showed PCB levels of between 878 and 2246 $\mu$g of PCB's/100 $cm^2$. After washing with VARSOL solvent, the readings dropped to between 143 and 18.5 $\mu$g of PCB's/100 $cm^2$. The cooling fins were rinsed by circulating varsol solvent through them. To verify the results of this technique, the fins had to be removed from the transformer and cut open.

The following table shows the contamination found on the interior transformer parts:

| AREA TESTED | SOLVENT | RESULTS |
|---|---|---|
| cover | none | 878 $\mu$g/100 Cm$^2$ |
| cover | sandblast | 24 $\mu$g/100 Cm$^2$ |
| upper tank | none | 1878 $\mu$g/100 Cm$^2$ |
| middle tank | none | 2246 $\mu$g/100 Cm$^2$ |
| inside cover | 3 washes VARSOL solvent | 79 $\mu$g/100 Cm$^2$ |
| cover plate | 3 washes VARSOL solvent | 18.5 $\mu$g/100 Cm$^2$ |
| cover | paint remover | 74.7 $\mu$g/100 Cm$^2$ |
| indside cover | grinding & paint remover | 37 $\mu$g/100 Cm$^2$ |
| cooling fin | VARSOL solvent rinse, 2 hours | 143 $\mu$g/100 Cm$^2$ |
| cooling fin | none | 792 $\mu$g/100 Cm$^2$ |
| copper wire | VARSOL solvent | 1.4 ppm, (150 $\mu$g/100 Cm$^2$) |

The results indicate as follows. The levels of PCB surface contamination which were able to be attained by washing the interior of the transformer will make it possible to replace the core and coil with new core and coil, refill the transformer with a non-flammable insulating fluid and have the resulting transformer below the required 50 ppm. This level would not be subject to leach back as happens with other decontamination processes.

Because of the physical construction of the core and coils, this portion of the transformer could not be cleaned below the levels of 2.5 $\mu$g of PCB's/100 cm$^2$. While there is no Federal surface contamination criterion these levels have been designated by EC as a permissible contamination criterion therefore neither the core nor coil could be reused or recycled. They will be packaged and placed into storage for eventual destruction.

It should be noted that a variety of modifications may be made without departing from the essence of the invention expressed in the main claim of this application and all such modifications are within the scope of the invention.

What is claimed is:

1. A method of decontaminating a polychlorinated biphenyls (PCB) transformer to a level below 50 ppm when the transformer is re filled with a non-PCB insulating fluid, which comprises:

(a) removing a transformer core/coil assembly from the PCB transformer from which PCB has been drained off, wherein the core and coil in said transformer core/coil assembly are not recycled or reused in the PCB transformer and the transformer core/coil assembly is eventually destroyed;

(b) washing all interior surfaces and remaining components of the transformer other than the transformer core/coil assembly by application of a non-volatile cleaning solvent to remove PCB, wherein the washing includes a circulation of the non-volatile cleaning solvent through cooling fins of the transformer, such that when the transformer is re-filled with the non-PCB insulating fluid, the PCB level is below 50 ppm;

(c) draining the non-volatile cleaning solvent form the transformer;

(d) installing a new transformer core/coil assembly which has had no previous contact with PCB, into the cleaned transformer; thereby making the transformer ready to be re-filled with the non-PCB insulting fluid, wherein the transformer core/coil assembly removed from the PCB transformer in step (a) is placed in storage to be eventually destroyed; and (e) refilling the transformer with said non-PCB insulating fluid such that the PCB level is below 50 ppm.

2. The method according to claim 1, which further comprises between steps (c) and (d);

(f) flushing interior surfaces of the cooling fins of the transformer with the non-PCB fluid, so as to remove the non-volatile cleaning solvent which may remain on the interior surfaces of the cooling fins.

3. The method according to claim 1, wherein in step (b), the non-volatile cleaning solvent is circulated 2 to 5 times through the cooling fins of the transformer.

4. The method according to claim 1, wherein the non-volatile cleaning solvent in step (b) is a non-volatile hydrocarbon solvent.

5. The method according to claim 1, wherein step (b) comprises applying the non-volatile cleaning solvent 2 to 5 times to all interior surfaces and remaining components of the transformer.

6. The method according to claim 2, wherein the non-PCB fluid is viscous at room temperature and is heated to facilitate a flushing action before it is used in step (e).

7. The method according to claim 4, wherein the non-volatile hydrocarbon solvent is an aliphatic hydrocarbon solvent having a boiling point of from about 150° C. to about 200° C.

* * * * *